US011607585B2

(12) United States Patent
Schmidt

(10) Patent No.: US 11,607,585 B2
(45) Date of Patent: Mar. 21, 2023

(54) GLUTE BRIDGE APPARATUS

(71) Applicant: Ken Schmidt, Santa Fe Springs, CA (US)

(72) Inventor: Ken Schmidt, Santa Fe Springs, CA (US)

( * ) Notice: Subject to any disclaimer, the term of this patent is extended or adjusted under 35 U.S.C. 154(b) by 0 days.

(21) Appl. No.: 17/235,219

(22) Filed: Apr. 20, 2021

(65) Prior Publication Data

US 2021/0322823 A1 Oct. 21, 2021

Related U.S. Application Data

(60) Provisional application No. 63/012,359, filed on Apr. 20, 2020.

(51) Int. Cl.
*A63B 23/04* (2006.01)
*A63B 21/00* (2006.01)
*A63B 21/055* (2006.01)

(52) U.S. Cl.
CPC ..... *A63B 23/0482* (2013.01); *A63B 21/0557* (2013.01); *A63B 21/4015* (2015.10)

(58) Field of Classification Search
CPC ..... A63B 23/0482; A63B 21/02–0557; A63B 21/4009–4011; A63B 21/4015
See application file for complete search history.

(56) References Cited

U.S. PATENT DOCUMENTS

| | | | | |
|---|---|---|---|---|
| 4,909,505 | A | 3/1990 | Tee | |
| 5,100,129 | A * | 3/1992 | Porter | A63B 23/08 482/79 |
| 5,129,647 | A | 7/1992 | Castellanos | |
| 5,303,716 | A | 4/1994 | Mason | |
| 5,318,494 | A | 6/1994 | Santighian | |
| 5,653,668 | A | 8/1997 | Wilkinson | |
| 6,361,517 | B1 | 3/2002 | Slinger | |
| 7,955,236 | B2 | 6/2011 | Digiovanni | |
| 8,012,071 | B2 * | 9/2011 | Grisdale | A63B 21/0552 482/125 |
| 8,282,536 | B2 | 10/2012 | Latronica | |
| 9,017,235 | B2 | 4/2015 | Khademi | |
| 9,079,062 | B2 | 7/2015 | Thomas | |
| 9,610,471 | B1 | 4/2017 | Langlois | |
| 9,656,115 | B2 | 5/2017 | Young | |
| 2005/0177927 | A1 | 8/2005 | Hettich | |
| 2008/0125685 | A1 | 5/2008 | Bernardoni | |
| 2013/0143723 | A1 | 6/2013 | Bender | |
| 2015/0251040 | A1 | 9/2015 | Pinder | |
| 2015/0335937 | A1 * | 11/2015 | Park | A63B 21/4043 482/121 |
| 2017/0105864 | A1 | 4/2017 | Muccio | |
| 2018/0178058 | A1 * | 6/2018 | Fano | A63B 21/4023 |

FOREIGN PATENT DOCUMENTS

| | | |
|---|---|---|
| AT | 411428 B | 1/2004 |
| KR | 1020090124898 | 12/2009 |
| WO | 2015169303 | 11/2015 |

* cited by examiner

*Primary Examiner* — Jennifer Robertson
(74) *Attorney, Agent, or Firm* — Lambert Shortell & Connaughton; David J. Connaughton, Jr.; Justin P. Tinger

(57) ABSTRACT

An exercise device is provided. The exercise device is formed of a resistance loop wearable over the waist and feet to provide resistance for performing glute bridge exercise. The resistance loop is light weight and portable and allows resistance glute bridge exercise to be performed anywhere a glute bridge exercise may be performed.

18 Claims, 8 Drawing Sheets

*Fig.* 4

GLUTE BRIDGE APPARATUS

FIELD

The present invention relates to a wearable resistance loop (an apparatus) that facilitates the building of the gluteus maximus muscles.

BACKGROUND

During the 1970's the world began a fitness revolution. In the 1970's many Americans for the first time began exercising at home, running, or lifting weights on a daily basis. The importance and benefits of exercise have become more and more apparent since then with Americans living healthier and longer lives. Resistance training has been increasingly identified as an important way to improve not only specific targeted regions, but also cardiovascular, and mental health. Today, in 2021, especially with the advent of social media, exercising and lifting weights has continued to grow and in popularity and size. However, still today, many people struggle to consistently access and maintain fitness regimens. This often stems from the large and heavy resistance-training machines that either take up space in a home or require going to a gym. Given the large and heavy nature of resistance training devices, it is also difficult to exercise outdoors, when 'on-the-go', or when traveling. Therefore, there is a need for portable, efficient, and convenient, resistance exercise equipment that can be easily transported, and used anywhere, and does not require excessive set-up in a user's home, or other exercise location.

A glute bridge exercise is performed by laying on your back with knees bent and driving the hips into the air while flexing the gluteus maximus muscles. The glute bridge exercise is also known as a hip thrust exercise or a laying hip thrust exercise, each shall be known collectively in this specification as a glute bridge exercise. A glute bridge exercise with resistance is performed by laying a weighted bar across your hips while driving your hips upward. Or alternatively, there are weight machines that add resistance to your hips and waist area and or surrounding areas as you drive your hips forward. The weighted bar and or the weight machines are expensive, bulky, and typically require at a minimum a home gym if not a full corporate gym.

The present invention allows the glute bridge exercises to be performed with resistance in any location in which a glute bridge without resistance may be performed, and without the need for expensive and bulky gym equipment.

SUMMARY

In one embodiment of the invention, the invention comprises a loop, band, strap, or belt (collectively defined herein as a loop) of a stretchable material with additional openings within the loop to place and secure one's feet into the loop. The loop may be a closed loop in some embodiments, and in other embodiments, may be an open loop such that a strap has foot openings attached or formed at opposite ends of the strap.

To use the present invention one inserts their feet into the foot openings of the loop and then moves the alternative portion of the loop over their knees and around the front of their hips which then provides resistance to the hips while performing a glute bridge and while keeping the loop secured to the feet.

In a further embodiment of the invention, securing the loop under one's feet by placing one's feet into the foot openings prevents the loop from retracting and subsequently striking the individual's posterior (hamstrings or glutes) while performing a glute bridge exercise. In one embodiment of the present invention a loop or unit is worn on the feet via the foot openings and across the waist simultaneously. In a further embodiment of the present invention a loop is worn on the feet, alongside each leg, and across the waist of a user simultaneously. In a further embodiment of the present invention the loop is a single and cohesive unit worn on the feet and on the front of the waist or the front of the user's upper legs (i.e. the quadriceps and tensor fasciae latae) simultaneously for the purpose of resistance training.

In one embodiment of the present invention the invention is composed of a material which is stretchable or flexible.

In one embodiment, the present invention consists of a loop with only two openings within the loop to place and secure one's feet and is a singular unit, and is not comprised of any additional accessories, attachments, or accoutrements. In a further embodiment of the present invention, the loop or open loop may be put on or worn without fastening, tying, or any type of adjustment. In a further embodiment of the present invention, the loop rest on the upper hips of the user and provides resistance without encircling the waist.

In a separate embodiment of the present invention the feet openings are each comprised of a strip of material attached to the larger loop creating openings in which a person's feet may be inserted.

In a further embodiment the loop may be comprised of material that is double-layered with the two layers left unconnected at each foot opening for the individual's feet to fit into the loop. In a further embodiment, the two layers may be connected together continuously or periodically along the remainder of the length of the loop.

In a further embodiment of the present invention an additional piece of material or additional tube or open sock is attached within the unsewn openings of the double-layered loop, band, or belt. In a further embodiment the flexible material in which the loop is made from will allow individuals with different foot size to use the loop.

The securing of the loop under one's feet by use of the foot openings is a key advantage of the present invention over resistance bands without foot openings. An additional aspect of the present invention is that securing of one's feet into the loop allows the individual to adjust the resistance by moving their feet forward and back while in position to perform the glute bridge. The capability to adjust the resistance of the loop vis-à-vis the positioning of the feet in the loop is a key advantage of the present invention over equipment currently available on the market today. The further away the feet are from the user's hips, the tighter the band will be and therefore the greater the resistance will be.

In a further embodiment the loop may be adjusted for individuals of different heights at extension regions of the apparatus such as by use of a buckle, a clamp, a hook and loop connector such as Velcro®, or any other adjustment mechanism.

In a further embodiment the loop may be composed of a material with different resistances to make the glute bridge exercise more or less difficult. In an additional embodiment the loop is made from a material which will not chafe or damage an individual's skin. The difference of materials in a key advantage of the present invention over rubber resistance bands.

In a further embodiment of the present invention an additional piece of material or additional tube or open sock is attached within the unsewn openings of the double-layered loop, band, or belt. In a further embodiment the flexible material in which the loop is made from will allow individuals with different foot sizes to use the loop.

In an additional embodiment the loop is made from a material which will not chafe or damage an individual's skin such as a stretchable fabric including, but not limited to spandex. The difference of materials in a key advantage of the present invention over rubber resistance bands. In a further embodiment, the loop may have a predetermined resistance level based on the flexibility of the material of which it is composed. In another embodiment of the invention, the length of the loop is made longer or shorter to increase or decrease the resistance of the loop and consequently make the glute bridge exercise while wearing the loop more or less difficult. In a further embodiment the loop may be adjusted in length to add resistance and therefore make the glute bridge exercise while wearing the loop more or less difficult. In a further embodiment the loop is composed of stretchable and nonstretchable material. In a further embodiment the length the of the loop is composed of stretchable and non-stretchable material that may be adjusted in length without increasing the resistance of the loop.

In a further embodiment of the invention, the loop has an additional pad surrounding the loop where the loop contacts an individual's hips. In a separate embodiment the additional pad is a long cylindrical tube pad formed to either be permanent or removable from the loop. In a further embodiment, said additional pad is in the shape of a long triangle to prevent the loop from rolling down the individual's waist while performing the glute bridge and can be permanent or removable.

In a further embodiment the removable pad will be of any shape or size to aid in comfort and reduce slipping of the loop while performing glute bridges. In another embodiment of the invention, a portion of the loop is composed of a padded or more padded material where the loop will make contact with an individual's hips to reduce any discomfort caused by the resistance in the loop while performing a glute bridge. In another embodiment of the invention, the portion of the loop which contacts an individual's hips and the front of the user's waist is made from a material with a higher friction coefficient to reduce slippage of the loop while performing glute bridges. In a further embodiment of the invention, any of the said pads, whether removable or not removable, are made from a material with a higher friction coefficient to reduce slippage while performing a glute bridge exercise.

DETAILED DESCRIPTION

Figure 1:
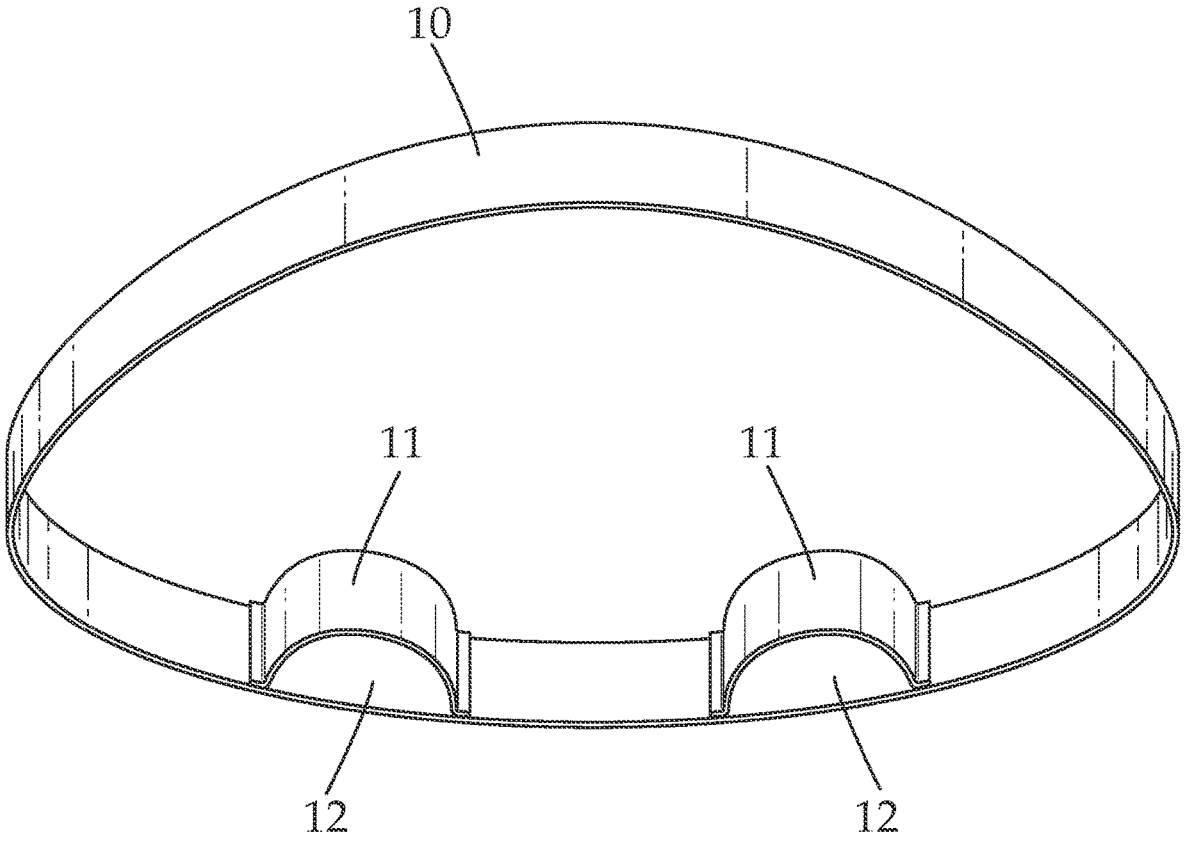
FIG. 1 depicts an upper perspective view of an embodiment of the apparatus.

The following description and examples illustrate a preferred embodiment of the present invention in detail. Those of skill in the art will recognize that there are numerous variations and modifications of this invention that are encompassed by its scope. Accordingly, the description of a preferred embodiment should not be deemed to limit the scope of the present invention.

In one embodiment of the present invention the present invention consists of a loop of flexible material with two foot openings and capable of being worn on the user's feet and across the user's waist while performing a glute bridge exercise.

In alternative embodiments of the present invention the two openings for the feet are created by attaching an additional strip of material to the loop of flexible material. In a preferred embodiment the additional strip of material is also flexible material so that openings are flexible on both sides and synch around a user's feet. In a further embodiment the additional material is different material than that of the loop to enhance the wearability (fit) of a user's feet. For example, in some embodiments the additional material attached to the loop to create the foot openings may be more flexible than the loop material to increase the range of size of feet and shoes or both which may fit into the openings. In a further embodiment the additional material is soft or lined to enhance the wearability (fit) and comfort (feel) of the user's feet. The strip or strips forming the foot openings may be permanently attached to the loop in one embodiment. In another embodiment, one end of the strip or strips may be permanently attached to the loop to form the foot opening, with an opposite end of the strip being removably connectable to the loop, so as to allow adjustable foot opening sizing, as well as easy release of the feet from the foot openings. In still another embodiment, both ends of the strip or strips may be removably connectable to the loop, so as to allow adjustable foot opening sizing, as well as easy release of the feet from the foot openings.

In a preferred embodiment the present invention the loop and the additional material to create the foot openings are 4 inches wide. In further embodiment the loop material and additional attached material for the foot openings are 1 inch to 15 inches wide. In a further embodiment of the present invention the additional material attached to the loop to create the foot openings varies in width from the loop from which it is attached.

In preferred embodiment of the invention the additional material attached to the loop to create the foot openings is 8 inches in length and is secured at each end to an area which is 6 inches in length along the loop. In further embodiments of the present invention the additional material attached to the loop to create the foot openings may range from 2 inches to 12 inches and may be attached to a portion of the loop that ranges from 2 inches to 12 inches. In the preferred embodiment the additional length of the attached material in comparison to the loop material creates an arch shape or bows the additional attached material so that a user may insert their feet. In another embodiment of the present invention the additional material attached to the loop to create the foot openings are attached to a portion of the loop that is the same length as to not create arches or bows for the foot openings, but rather an unopened foot opening or envelope. In a preferred embodiment of the invention the additional material attached to the loop to create the foot openings are spaced 5 inches apart. In further embodiment of the present invention the foot openings are spaced anywhere from ½ of an inch apart to 60 inches apart. In a further embodiment the additional material attached to the loop to create the foot openings is sewn or attached in diagonal fashion to create an opening that is slightly larger on one side than the other, in order to create a tapered or contoured foot opening.

In a further embodiment the additional openings are paired for different sizes of feet, for example women's feet and men's feet, or, with shoes and without shoes. It should be noted however, that the invention contemplates use of flexible material which is capable of stretching and securing a majority of feet and shoes of various different sizes with one set of openings. The foot openings may be used by a user having shoes on, wearing socks, and/or barefoot, without straying from the scope of the invention.

In an additional embodiment of the present invention the loop has a single opening for both feet to fit securely into. Such single opening may be created using additional material in various lengths as described above for paired openings and multiple pair openings.

In additional embodiments of the present invention the loop may be made from two strips or pieces of material attached together to create a double loop. In a preferred embodiment, the material used for the outer loop and the inner loop will be of the same width. In a preferred embodiment the inner loop will not be attached to the outer loop in certain areas to create openings for the user's feet. In a preferred embodiment the inner loop will be four inches longer than the outer loop such as to create two foot openings or sleeves with arched or bowed foot openings. In a preferred embodiment the openings will be composed of sections of material which are 6 inches on the outside band and 8 inches on the inside band to create sleeves and the openings will be 5 inches apart. In a further embodiment the foot openings may vary in size as demonstrated above for the foot openings created by the additional attached material. In further embodiments such double loop may be attached or sewn together in various places so as to leave openings which may be worn on the feet. In additional embodiments the double loop will be composed of two pieces of material identical or nearly identical in length to create no arches or bowed effect at the foot openings. In such an embodiment the foot openings or sleeves are intentionally not perceivable.

In a preferred embodiment of the present invention the loop will be composed of material with known resistance. In a further embodiment, the loop may have a predetermined resistance level based on the flexibility of the material in which they are composed of. In one embodiment of the present invention the resistance of the material will be equivalent to 50 pounds or resistance. In additional embodiments of the invention the resistance of the material will range from 1 pound of resistance to 1000 pounds of resistance. In a further embodiment of the present invention the double loops discussed above may be created with material with the same resistance to create a final double loop for use with double the resistance (for example two 50 pound resistance bands attached together will create a 100 pound resistance double loop). In further embodiments the double loop may be created with material with different resistances to create a final double loop with varying final resistances, for example a 50 pound resistance loop attached to a 100 pound resistance loop for a total of 150 pound final resistance loop.

In a preferred embodiment of the present invention the loop will be 26 inches long when laid flat, and therefore will be composed of 52 inches of material when not enclosed in a loop. In an additional embodiment of the invention the loop will be 5 inches to 100 inches when laid flat, and therefore be comprised of 10 inches to 200 inches of material. In another embodiment of the invention, the length of the loop is made longer or shorter to increase or decrease the resistance of the loop, and consequently make the glute bridge exercise while wearing the loop more or less difficult. In a further embodiment the loop may be adjusted in length to add resistance and therefore make the glute bridge exercise while wearing the loop more or less difficult. In a further embodiment the loop is composed of stretchable and non-stretchable material. For example the portion of the loop that is worn along the side of the legs is stretchable and is a designated resistance while the portion the loop is worn on the waist and over the feet is non-stretchable, or vice-versa. In a further embodiment of the invention the non-stretchable or, portion of the loop that does have flexible resistance will be adjustable to allow the loop to be set resistance but be adjustable for different sized users. For example, a 50-pound resistance band could be extended to 30 inches or decreased to 20 inches while maintaining the same resistance.

In a preferred embodiment of the present invention the loop is adjustable through use of a locking buckle which would be placed on the portion of the loop that is worn on the outer legs of the user. In a further embodiment the locking buckle would be positioned on both sides of the loop that is worn on the outside of the legs. In an additional embodiment the adjustable locking buckle or buckles may be placed anywhere along the length of the loop In a further embodiment of the present invention the loop may be constructed of rubber tubing, or bungee like material. In a further embodiment the loop could be comprised of a series of rubber tubing, or bungee like material so that the foot openings would be formed by attachments of the tubing or bungee like material at specified locations. The foot openings between the tubing could be any dimension suitable for use.

In a further embodiment of the present invention, the loop has an additional pad surrounding the loop where the loop is worn across the waist. In a further embodiment the pad is a long cylindrical tube which may be removed from the portion of the loop worn across the waist. In a further embodiment, said additional pad is in the shape of long triangle to ensure the tube stays along the waist of the user. In a further embodiment the pad may be attached to the loop where the loop is worn along the front of the waist. In a separate embodiment of the present invention the pad is placed on any portion of the loop which is suitable. In another embodiment of the present invention the pad is permanently attached to the loop. In a preferred embodiment of the present invention the loop comprised of rubber tubing or bungee cord like material has a pad surrounding the tubing to distribute the weight across the waist more broadly.

Figure 2:
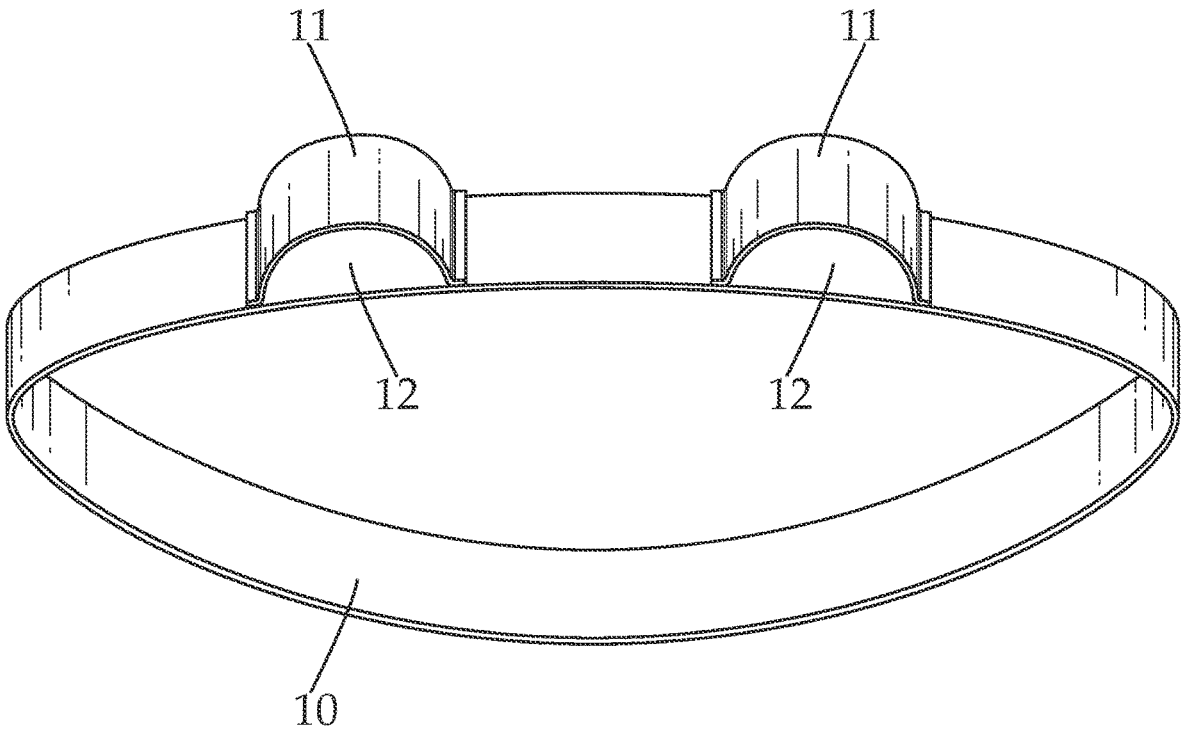
FIG. 2 shows an upper perspective view of another embodiment of the apparatus.
Figure 3:
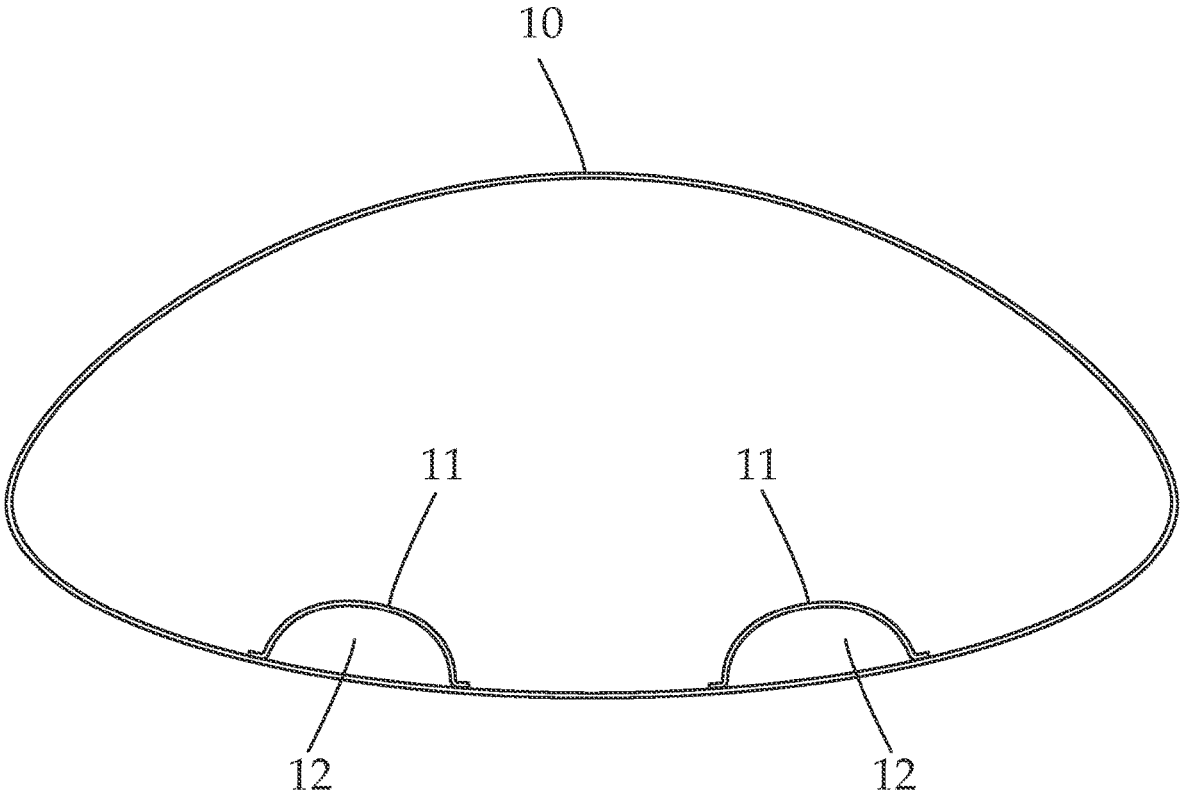
FIG. 3 is a side view of an embodiment of the apparatus.

Turning to FIGS. 1-3, perspective and side views of the apparatus of the present disclosure are shown. The apparatus comprises a loop 10 formed of a stretchable material, having, in this embodiment, two foot openings 12. The foot openings 12 are formed in this view by strips 11 which define the foot opening 12 on one side, while the opposite side of the foot opening 12 is bounded by the loop 10. The strips 11 may be connected to the loop directly, indirectly, or integrally formed with the loop material by, for example, weaving and/or molding.

Figure 4:
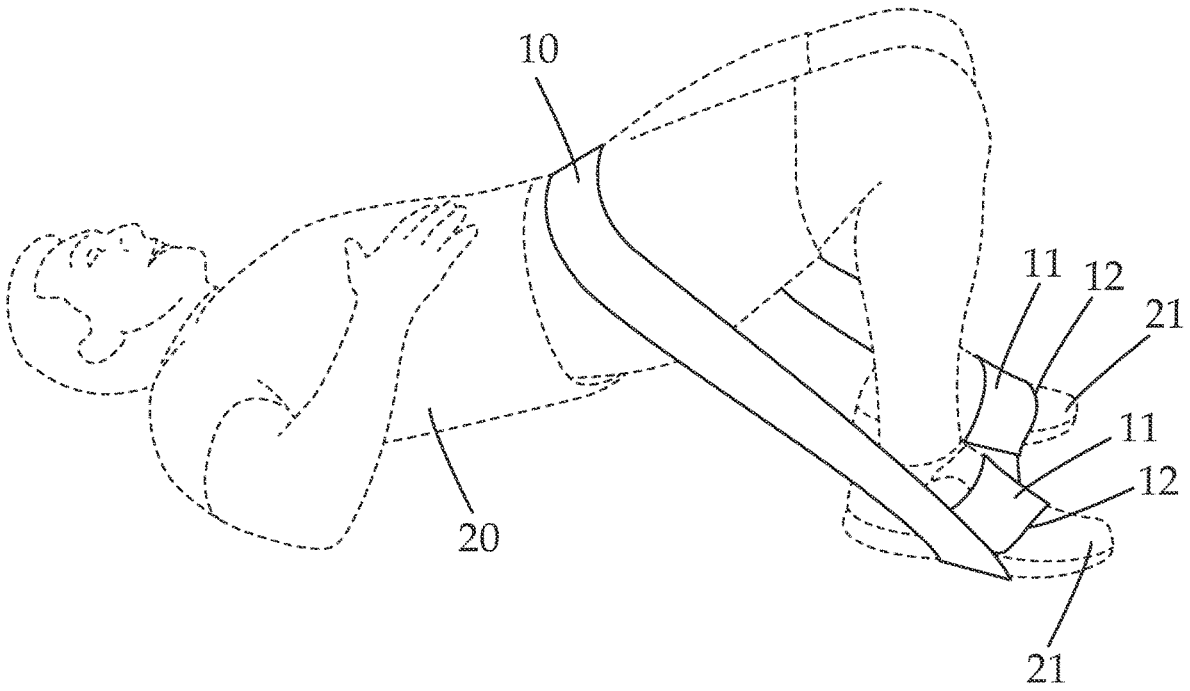
FIG. 4 shows an embodiment of an embodiment of the apparatus in use.
Figure 8:
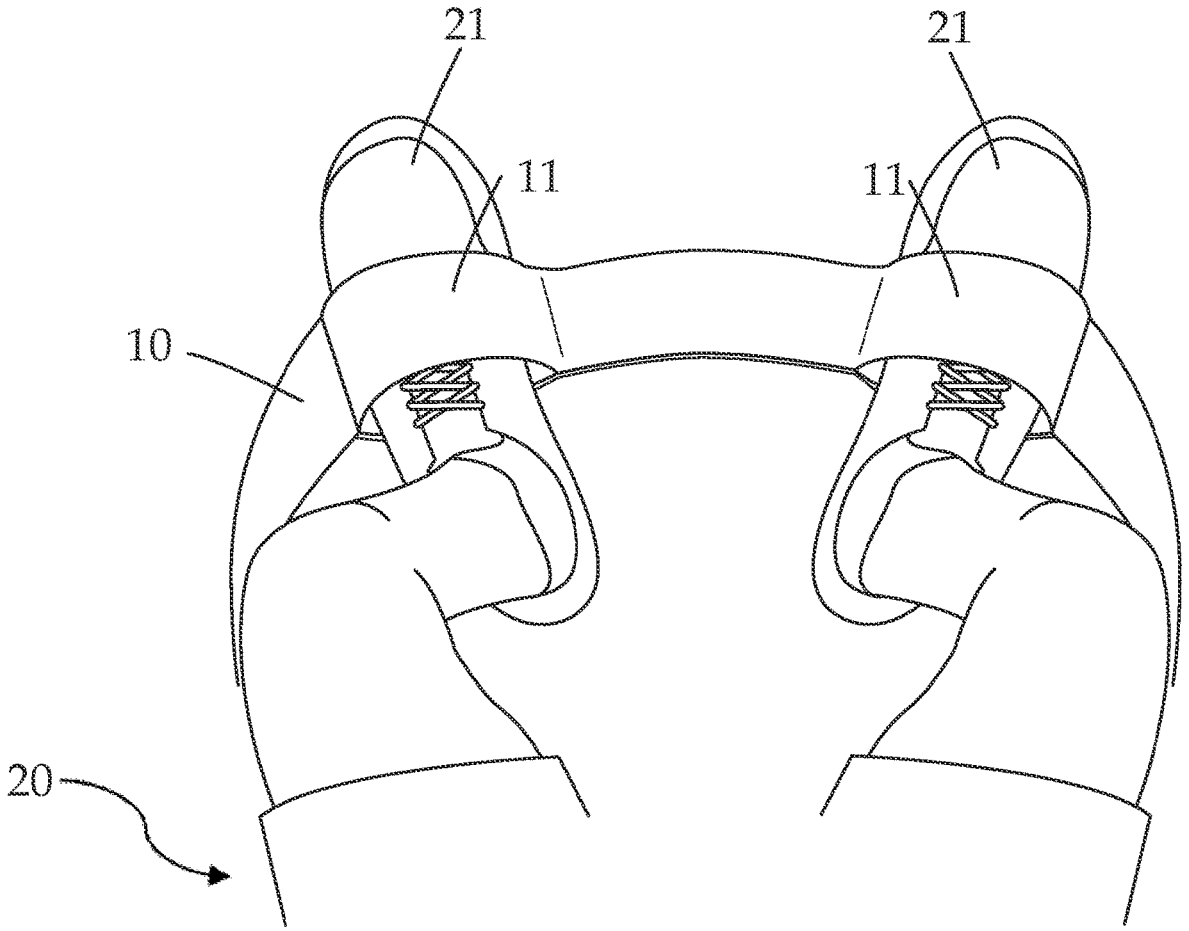
FIG. 8 provides a perspective view of an embodiment of the apparatus in use.

FIGS. 4 and 8 provide views of an embodiment of the apparatus in use. Here, a user 20 has the loop 10 engaged with the front of his hips, and with both feet 21 passing through foot openings 12. Here, user is shown wearing shoes 21 but of course the apparatus may be used with bare feet, socks, other foot coverings, and the like without straying from the scope of this invention. The loop 10, in this embodiment, is positioned on an outside of the user's legs. To engage in the exercise, the user raises his hips off the floor against a resistance of the loop 10 material stretching. The loop 10 is held in place by the user's feet 21 engaged with foot openings 12 preventing it from moving.

Figure 5:
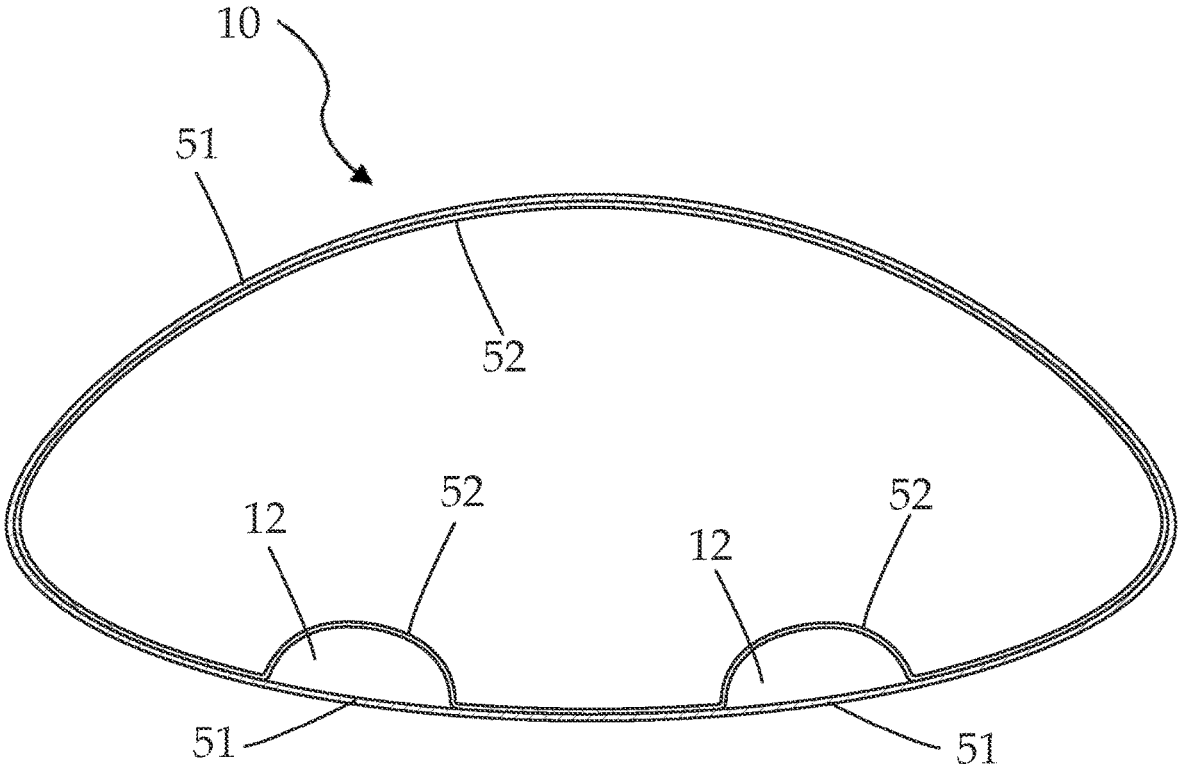
FIG. 5 shows a side view of yet another embodiment of the apparatus.
Figure 6:
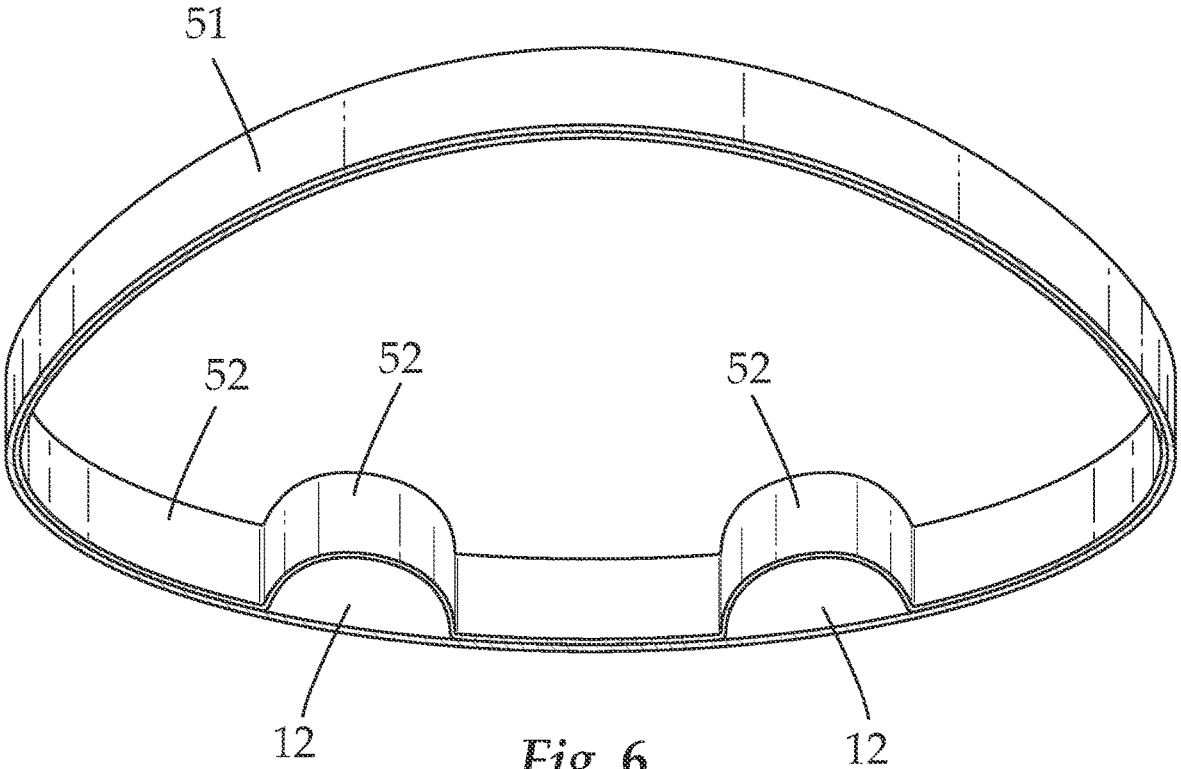
FIG. 6 shows a side view of still another embodiment of the apparatus.

FIGS. 5 and 6 show views of a double layered loop. The stretchable loop 10, in this embodiment, is formed of a first loop material 51 and second loop material 52. In this embodiment, foot openings 12 are formed by the second loop material 52 being disconnected from the first loop material across the foot opening area, creating a separation of the two loop strips. In varying embodiments, the first loop material 51 and second loop material 52 may be held together or connected at various points along the length of the loop.

Figure 7:
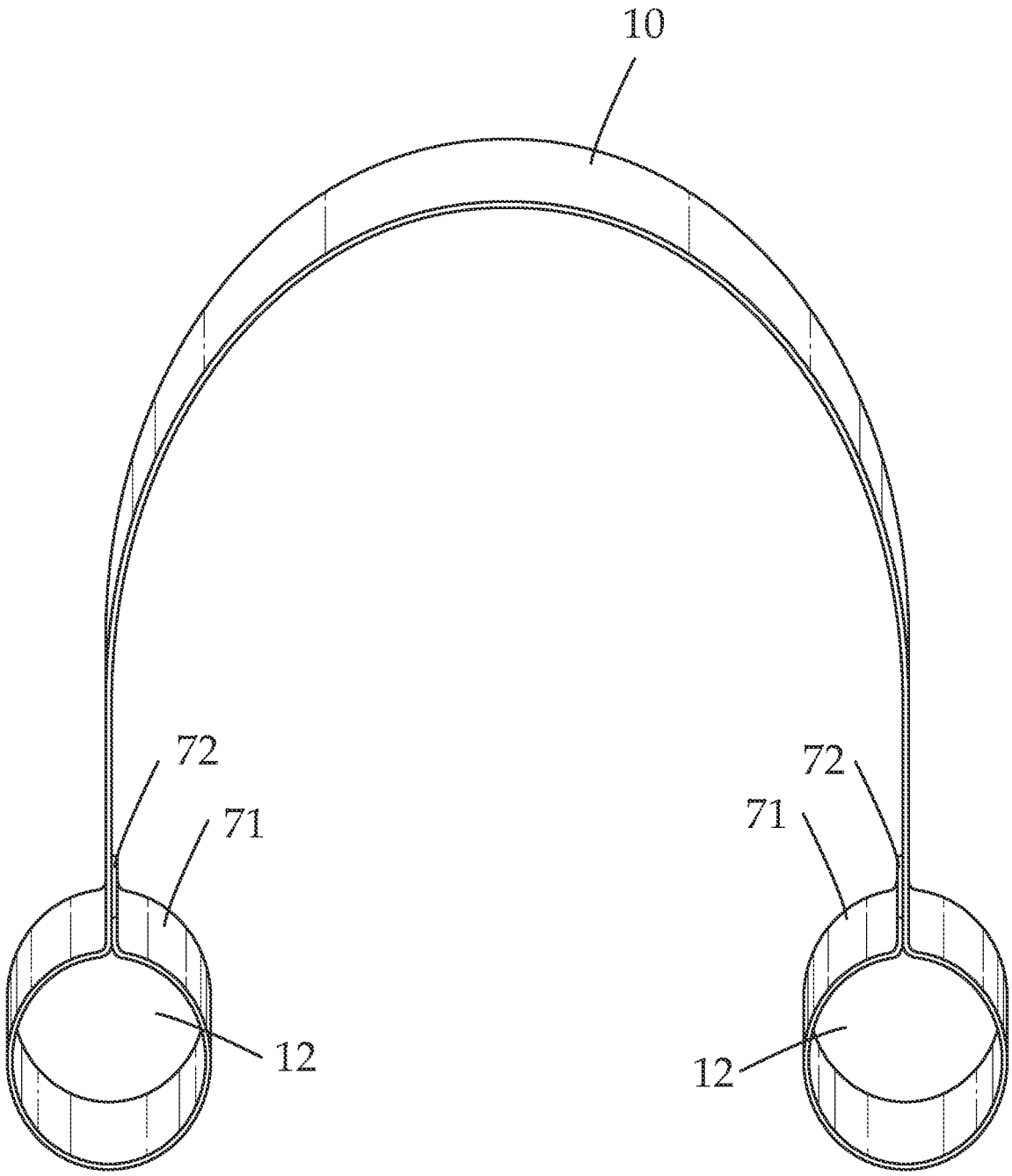
FIG. 7 shows a perspective view of another embodiment of the apparatus.

FIG. 7 shows an embodiment of the apparatus having an open loop with foot openings at each opposite end of the loop. Here, loop 10 forms is formed as an elongate strap of stretchable material. Foot openings 12 are positioned at each end of the loop 10. The foot openings 12 may be formed of the same or different material from the loop 10. In this embodiment, each end portion 71 of the loop 10 material is connected to the loop 10 itself at connection area 72, thereby forming the foot openings 12. Of course, other structures to form the foot openings may be employed without straying from the scope of this invention.

Figure 9:
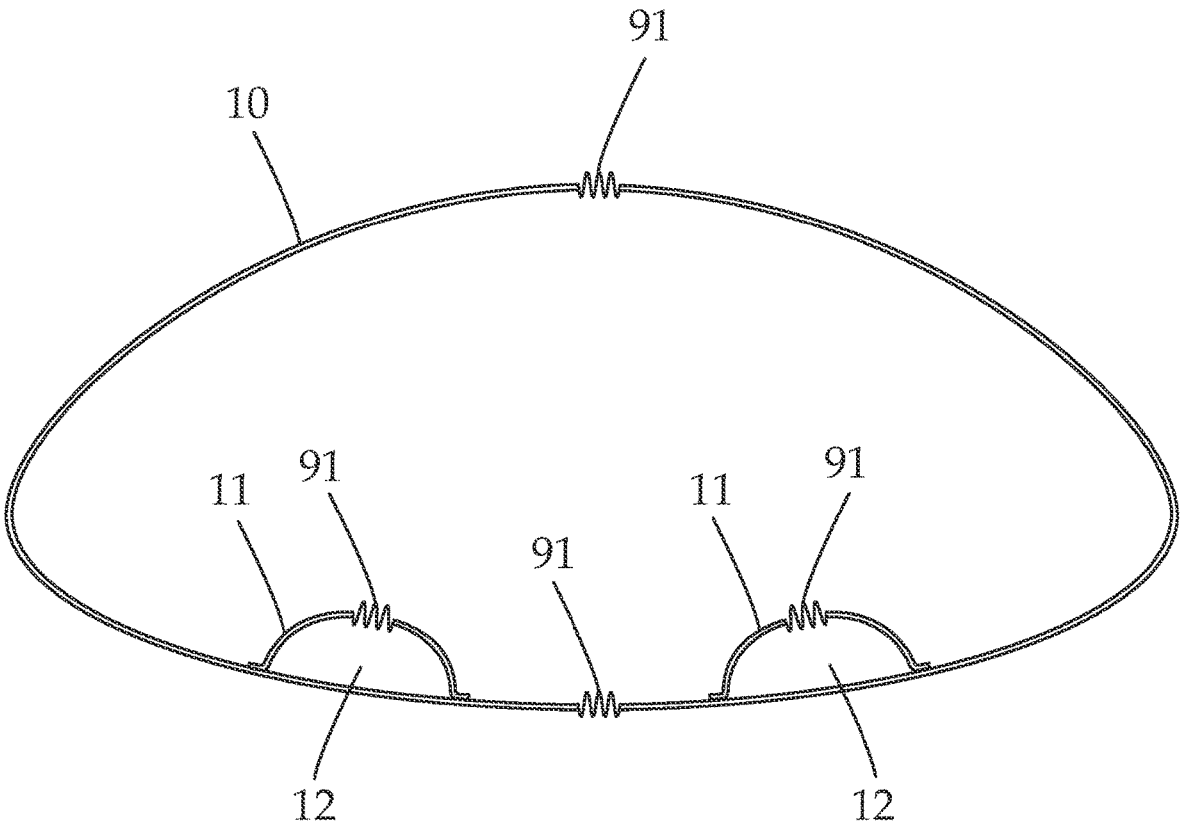
FIG. 9 provides a side view of yet another embodiment of the apparatus.

FIG. 9 provides another embodiment of the apparatus disclosed herein. In this embodiment, the apparatus comprises a loop 10 formed of a stretchable material, having, in this embodiment, two foot openings 12. The foot openings 12 are formed in this view by strips 11 which define the foot opening 12 on one side, while the opposite side of the foot opening 12 is bounded by the loop 10. The strips 11 may be connected to the loop directly, indirectly, or integrally formed with the loop material by, for example, weaving and/or molding. In addition, the loop 10 comprises extension regions 91. Extension regions 91 are shown as a zig zagging line, but it is to be understood that this extension region 91 may be any number of different structures which allows for a shortening or lengthening of the loop 10 and/or foot opening strips 11. Extension region 91 may be formed as a buckle, a clamp, a hook and loop connector such as Velcro®, or any other adjustment mechanism.

All references cited herein are incorporated herein by reference in their entirety. To the extent publications and patents or patent applications incorporated by reference contradict the disclosure contained in the specification, the specification is intended to supersede and/or take precedence over any such contradictory material.

To the extent publications and patents or patent applications incorporated by reference herein contradict the disclosure contained in the specification, the specification is intended to supersede and/or take precedence over any such contradictory material.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, unless otherwise expressly stated, should be construed as open ended as opposed to limiting. As examples of the foregoing, the term 'including' should be read to mean 'including, without limitation' or the like; the term 'comprising' as used herein is synonymous with 'including,' 'containing,' or 'characterized by,' and is inclusive or open-ended and does not exclude additional, unrecited elements or method steps; the term 'example' is used to provide exemplary instances of the item in discussion, not an exhaustive or limiting list thereof; adjectives such as 'known', 'normal', 'standard', and terms of similar meaning should not be construed as limiting the item described to a given time period or to an item available as of a given time, but instead should be read to encompass known, normal, or standard technologies that may be available or known now or at any time in the future; and use of terms like 'preferably,' preferred,"desired," or 'desirable,' an words of similar meaning should not be understood as implying that certain features are critical, essential, or even important to the structure or function of the invention, but instead as merely intended to highlight alternative or additional features that may or may not be utilized in a particular embodiment of the invention. Likewise, a group of items linked with the conjunction 'and' should not be read as requiring that each and every one of those items be present in the grouping, but rather should be read as 'and/or' unless expressly stated otherwise. Similarly, a group of items linked with the conjunction 'or' should not be read as requiring mutual exclusivity among that group, but rather should be read as 'and/or' unless expressly stated otherwise. In addition, as used in this application, the articles 'a' and 'an' should be construed as referring to one or more than one (i.e., to at least one) of the grammatical objects of the article. By way of example, 'an element' means one element or more than one element.

The presence in some instances of broadening words and phrases such as 'one or more', 'at least', 'but not limited to', or other like phrases shall not be read to mean that the narrower case is intended or required in instances where such broadening phrases may be absent.

All numbers expressing quantities of ingredients, reaction conditions, and so forth used in the specification are to be understood as being modified in all instances by the term 'about.' Accordingly, unless indicated to the contrary, the numerical parameters set forth herein are approximations that may vary depending upon the desired properties sought to be obtained. At the very least, and not as an attempt to limit the application of the doctrine of equivalents to the scope of any claims in any application claiming priority to the present application, each numerical parameter should be construed in light of the number of significant digits and ordinary rounding approaches. Where a range of values is provided, it is understood that the upper and lower limit and each intervening value between the upper and lower limit of the range is encompassed within the embodiments.

Furthermore, although the foregoing has been described in some detail by way of illustrations and examples for purposes of clarity and understanding, it is apparent to those skilled in the art that certain changes and modifications may be practiced. Therefore, the description and examples should not be construed as limiting the scope of the invention to the specific embodiments and examples described herein, but rather to also cover all modification and alternatives coming with the true scope and spirit of the invention.

What is claimed is:

1. An exercise apparatus comprising:

a closed loop of stretchable material sized to be engaged with a front of a user's hips and with feet of the user, the loop having a fixed length at rest and having a predetermined resistance to stretching; and a foot opening formed at least partially by the loop, the foot opening sized to receive a foot of a user such that when the foot is engaged with the foot opening and the loop is engaged with the front of the user's hips, the user may apply a force against the loop, causing a stretching of the material;

wherein the foot opening is defined by a strip of material sewn to the loop opposite to the loop.

2. The exercise apparatus of claim 1 wherein the apparatus has exactly two foot openings.

3. The exercise apparatus of claim 1 wherein the apparatus has only one foot opening.

4. The exercise apparatus of claim 1 wherein the loop does not encircle the waist of the user.

5. The exercise apparatus of claim 1 wherein the loop is formed of two partially connected layers, and wherein the foot opening is defined on a top by one of the two layers, and on the bottom by the other of the two layers, the two layers being disconnected at the foot opening.

6. The exercise apparatus of claim 2 further comprising a shoe in each of the two foot openings.

7. The exercise apparatus of claim 2 further comprising a sock in each of the two foot openings.

8. The exercise apparatus of claim 1 wherein the loop comprises a stretchable fabric surrounding the stretchable material.

9. The exercise apparatus of claim 1 wherein a length of the loop is adjustable.

10. The exercise apparatus of claim 9 wherein the length of the loop is adjustable by one of a buckle, a hook and loop connector, and a clamp.

11. The exercise apparatus of claim 1 wherein the loop is formed of a combination of stretchable and non-stretchable material.

12. The exercise apparatus of claim 1 further comprising a pad attached to the loop on a side opposite to the foot openings.

13. The exercise apparatus of claim 1 wherein the foot opening is defined by a strip of material attached to the loop opposite to the loop, the strip being formed of a material which is more easily stretchable than the stretchable material of the loop.

14. An exercise apparatus consisting of:

a loop of stretchable material sized to be engaged with a front of a user's hips and with the feet of the user; and two foot openings formed at least partially by the loop, the two foot openings each sized to receive a foot of a user such that when the foot is engaged with the foot openings and the loop is engaged with the front of the user's hips, the user may apply a force against the loop, causing a stretching of the material.

15. The exercise apparatus of claim 14 wherein the two foot openings are each defined by a strip of material attached to the loop opposite to the loop.

16. The exercise apparatus of claim 14 wherein the loop is formed of two partially connected layers, and wherein each of the two foot openings are defined on a top by one of the two layers, and on the bottom by the other of the two layers, the two layers being disconnected at the foot openings.

17. The exercise apparatus of claim 14 wherein the loop is a closed loop.

18. A method of using an exercise apparatus comprising the steps of:

placing a first foot through a first foot opening of the exercise apparatus;

placing a second foot through a second foot opening of the exercise apparatus;

engaging a portion of a loop of the exercise apparatus with hips;

positioning the loop outside of the legs such that the loop passes over an outside lower leg and outside upper leg;

moving the hips forward while the feet are in a fixed position on the ground, the moving of the hips causing a stretching of a material of the loop; and adjusting the feet to a second fixed position to adjust a resistance provided by the loop of the exercise apparatus.

* * * * *